US009986356B2

(12) United States Patent
Horbach et al.

(10) Patent No.: US 9,986,356 B2
(45) Date of Patent: May 29, 2018

(54) AUDIO SURROUND PROCESSING SYSTEM

(75) Inventors: Ulrich Horbach, Canyon Country, CA (US); Anandhi Ramesh, Bangalore (IN)

(73) Assignee: Harman International Industries, Incorporated, Stamford, CT (US)

( * ) Notice: Subject to any disclaimer, the term of this patent is extended or adjusted under 35 U.S.C. 154(b) by 907 days.

(21) Appl. No.: 13/396,987

(22) Filed: Feb. 15, 2012

(65) Prior Publication Data

US 2013/0208895 A1 Aug. 15, 2013

(51) Int. Cl.

| | |
|---|---|
| ***H04R 5/00*** | (2006.01) |
| ***H04S 5/00*** | (2006.01) |
| *H04S 7/00* | (2006.01) |
| *H04S 3/00* | (2006.01) |

(52) U.S. Cl.

CPC ..... *H04S 5/005* (2013.01); *H04R 2205/024* (2013.01); *H04S 3/00* (2013.01); *H04S 7/30* (2013.01); *H04S 7/305* (2013.01); *H04S 2400/05* (2013.01)

(58) Field of Classification Search

USPC ..... 381/1–17, 61, 66, 307; 704/216, 224, 704/226, 500

See application file for complete search history.

(56) References Cited

U.S. PATENT DOCUMENTS 5,625,696 A * 4/1997 Fosgate ..... 381/18
6,198,826 B1 * 3/2001 Cowieson et al. ..... 381/18
7,412,380 B1 * 8/2008 Avendano et al. ..... 704/216
8,045,719 B2 * 10/2011 Vinton ..... H04S 5/00 381/27
8,107,631 B2 * 1/2012 Merimaa ..... H04S 7/30 381/1
8,126,172 B2 * 2/2012 Horbach et al. ..... 381/303
8,588,427 B2 * 11/2013 Uhle ..... H04R 5/04 381/17

(Continued)

OTHER PUBLICATIONS

Choi et al., A New Digital Surround Processing System for General A/V Sources, IEEE Transactions on Consumer Electronics, 41 Nov. 1995, No. 4, New York, US, 8 pgs.

(Continued)

*Primary Examiner* — Davetta W Goins
*Assistant Examiner* — Kuassi Ganmavo
(74) *Attorney, Agent, or Firm* — Brooks Kushman, P.C.

(57) ABSTRACT

An audio surround processing system receives an audio source signal having at least two audio channels and generates a number of additional surround sound signals in which an amount of artificially generated ambient energy is controlled in real-time at least in part by an estimate of ambient energy that is contained in the audio source signal. The system may divide the audio source signal into two sets of components; a first set of components and a second set of components. The first set of components may be in a range of frequency that is less than a range of frequency of the second set of components. An ambience estimate control coefficient may be generated using the transformed first set of components. An overall gain may be determined using the ambience estimate control coefficient. The overall gain may be used in generation of the additional surround sound signals.

24 Claims, 12 Drawing Sheets

(56) References Cited

U.S. PATENT DOCUMENTS

| | | | | |
|---|---|---|---|---|
| 8,605,914 | B2 * | 12/2013 | Neoran | H04S 5/00 381/1 |
| 8,705,769 | B2 * | 4/2014 | Vickers | 381/119 |
| 2006/0039573 | A1 | 2/2006 | Vernon et al. | |
| 2007/0041592 | A1 | 2/2007 | Avendano et al. | |
| 2008/0247555 | A1 | 10/2008 | Avendano et al. | 381/27 |
| 2009/0147975 | A1 | 6/2009 | Horbach et al. | 381/307 |
| 2010/0177903 | A1 * | 7/2010 | Vinton | G10L 19/008 381/20 |
| 2010/0183155 | A1 | 7/2010 | Kim | |
| 2010/0296672 | A1 * | 11/2010 | Vickers | 381/119 |
| 2012/0059498 | A1 * | 3/2012 | Berchin | G06K 9/0055 700/94 |

OTHER PUBLICATIONS

European Office Action, dated May 17, 2013, European Application No. 13154275.5-1910, 7 pgs.

Avendano, Carlos et al., A Frequency-Domain Approach to Multichannel Upmix, Jul./Aug. 2004, pp. 740-749, vol. 52, No. 7/8, J. Audio Eng. Soc.

Merimaa, Juha et al., Correlation-Based Ambience Extraction from Stereo Recordings, Presented at the 123rd Convention, Oct. 5-8, 2007, pp. 1-15, Audio Engineering Society.

European Office Action for European Application No. 13 154 275.5 dated Sep. 23, 2014.

European Office Action for European Application No. 13 154 275.5 dated Jun. 25, 2015.

* cited by examiner

AUDIO SURROUND PROCESSING SYSTEM

BACKGROUND OF THE INVENTION

1. Technical Field

This application relates generally to audio signal processing and, in particular, to generating a number of surround sound signals using an estimate of the ambient energy contained in the source signal.

2. Related Art

Two-channel recording is one of the popular formats for music recordings. The audio signal from a two-channel stereo audio system or device is limited in its ability to provide a true surround sound because only two frontal loudspeakers (left and right) are available. There is ongoing interest in generating realistic sound fields over more than two loudspeakers to enhance the acoustic experience of the listener. For multi-channel audio devices enhancing the sound experience beyond stereo involves the addition of surround sound signals in order to generate a surround sound effect for the listener. Technologies enabling a surround sound effect by processing a two-channel stereo sound signal have been implemented.

SUMMARY

An audio surround processing system to perform spatial processing of audio signals receives an audio signal having at least two channels (such as left and right audio channels) and generates a number of surround sound signals in which the amount of artificially generated ambient energy is at least partially controlled in real-time by estimated ambient energy that is contained in the source signal. The audio surround processing system may divide an audio signal having at least two channels into at least two sets of components, such as first and second components. The first and second components may be determined by identifying a low frequency range of the audio signal as the first component, and identifying a high frequency range of the audio signal as the second component. The first component may be transformed from a time domain to a frequency domain. An ambience estimate control coefficient may be generated using the transformed first component. The overall gain of the generated surround sound signals may be determined using the ambience estimate control coefficient.

A feature of the audio surround processing system involves extraction of a center channel from the audio signal. The audio surround processing system may extract a first center channel signal from the first component and extract a second center channel signal from the second component. The extracted first and second center channel signals may be combined to form an extracted center channel output signal.

Another feature of the audio surround processing system involves generation of surround sound signals using the audio signal and the extracted center channel output signal within a matrix. The generated surround sound signals may be output by the matrix and combined with synthesized surround sound signals to generate surround sound output signals on output channels.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The embodiments may be better understood with reference to the following drawings and description. The components in the figures are not necessarily to scale, emphasis instead being placed upon illustrating the principles of the invention.

DETAILED DESCRIPTION

Examples of an audio signal processing system (ASPS) will now be described with reference to the accompanying drawings. This system may, however, be embodied in many different forms and should not be construed as limited to the examples set forth. Rather, these examples are provided so that this disclosure will convey the scope of this disclosure to those skilled in the art. In the description, details of well-known features and techniques may be omitted to avoid unnecessarily obscuring the presented examples.

The terminology used in the specification is for the purpose of describing particular examples only and is not intended to be limiting of this disclosure. As used herein, the singular forms “a”, “an”, and “the” are intended to include the plural forms as well, unless the context clearly indicates otherwise. Furthermore, the use of the terms “a”, “an”, etc., do not denote a limitation of quantity, but rather denote the presence of at least one of the referenced items. It will be further understood that the terms “comprises” and/or “comprising”, or “includes” and/or “including”, when used in this specification, specify the presence of stated features, regions, integers, steps, operations, elements, and/or components, but do not preclude the presence or addition of one or more other features, regions, integers, steps, operations, elements, components, and/or groups.

Figure 1:
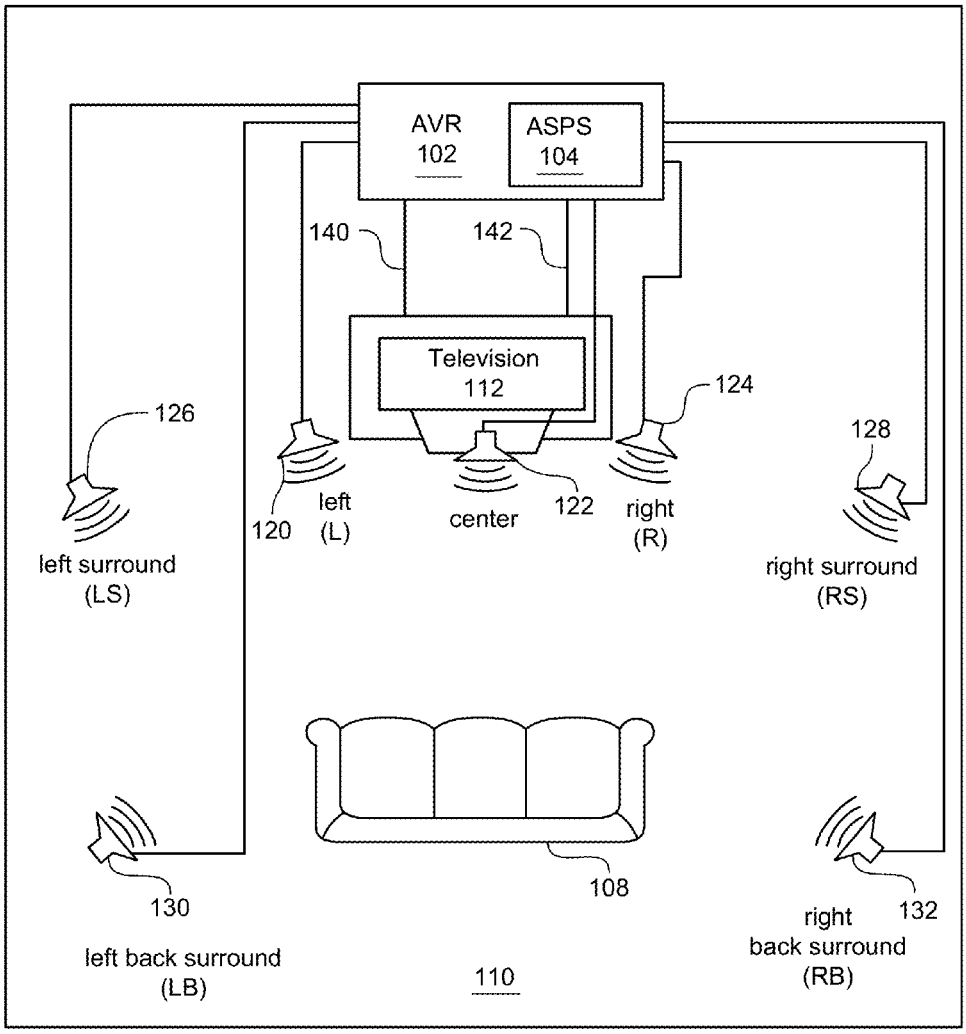
FIG. 1 illustrates a block diagram representation of an example audio surround processing system (ASPS) within a listening room.

FIG. 1 shows a block diagram representation depicting an example of audio/video receiver (AVR) 102 having an audio surround processing system (ASPS) 104 within a listening room 110. The AVR 102 may be connected to one or more audio generating devices. In FIG. 1, the example audio generating device is depicted as a television 112. In other examples, the audio generating device may be a DVD player, a Blu-ray™ player, a set-top-box, a game console (e.g., an Xbox360™ or a PlayStation3™), a car audio/video system, a compact disc player, a memory device (such as an MP3 player, IPOD or smart tablet), a personal computer, a high-definition television (HDTV) receiver, a cable television system, a satellite television system, and/or any other device or system capable of providing audio signals to the AVR 102.

The ASPS 104 may process an incoming audio signal, such as a two-channel stereo signal to generate additional audio channels, such as five additional audio channels, in addition to the original left audio channel and right audio channel signal. In other examples, any number of audio channels may be processed by the ASPS 104. Each audio channel output from the AVR 102 may be connected to a loudspeaker, such as a center channel loudspeaker 122, surround channel loudspeakers (such as left surround 126, right surround 128, left back surround 130, and right back surround 132), a left loudspeaker 120 and a right loudspeaker 124. The loudspeakers may be arranged around a central listening location or listening area, such as an area that includes a sofa 108 located in listening room 110. In FIG. 1, the example listening space is depicted as a room. In other examples, the listening space may be in a vehicle, outdoors, or in any other space where an audio system can be operated to produce audible sound.

In FIG. 1, the AVR 102 is connected to television 112 via a left audio cable 140 and right audio cable 142. The ASPS 104 within the AVR 102 may receive and process the left and right audio channels carried by the left audio cable 140 and right audio cable 142 and generate additional audio channels. In other implementations, the connection from the television 112 or other audio/video components to the AVR 102 may be via wires, fiber optics, or electromagnetic waves (radio frequency, infrared, Bluetooth™, wireless universal serial bus, or other non-wired connections), and may include additional channels.

Figure 2:
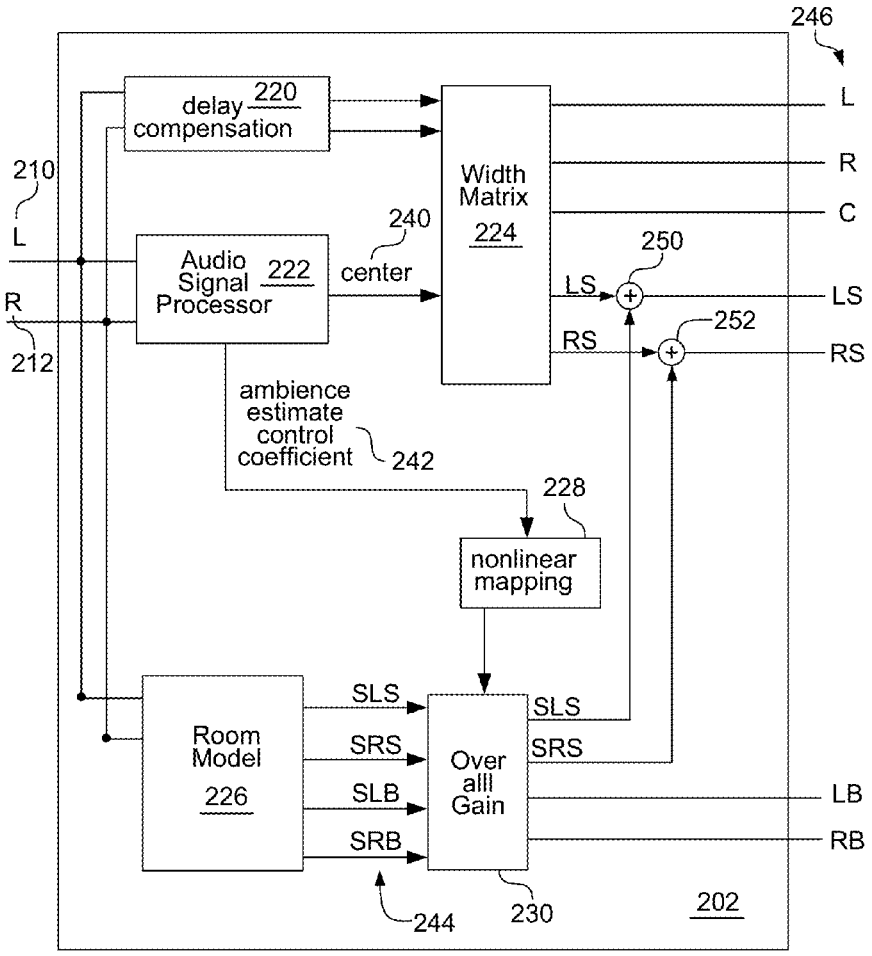
FIG. 2 illustrates a block diagram representation of an example ASPS for upmixing two to seven channels.

FIG. 2 is an example block diagram of an audio surround processing system (ASPS) 202 showing components for upmixing from two channels to seven channels. In other examples, any other number of channels may be illustrated. Audio signal processor module (ASP) 222 of ASPS 202 may generate a time-varying ambience estimate control coefficient 242 and derive a center audio channel 240 from incoming audio signals supplied on a left audio channel 210 and right audio channel 212. The ASP 222 may be a module executed by one or more processors included in the ASPS 202. The one or more processors, may be any computing device capable of processing audio and/or video signals, such as a computer processor, a digital signal processor, a field programmable gate array (FPGA), or any other device capable of executing logic. The processor may operate in association with a memory to execute instructions stored in the memory. The memory may be any form of one or more data storage devices, such as volatile memory, non-volatile memory, electronic memory, magnetic memory, optical memory, or any other form of device or system capable of storing data and/or instructions.

The time-varying ambience estimate control coefficient 242 may be an output signal of the ASP module 222 that represents an estimate of the magnitude or amount of ambient energy detected in the stereo source signal provided as the incoming left and right audio signals. The ambience estimate control coefficient 242 may be represented as one or more coefficients. The signal may be time varying in accordance with the audio content contained in the left and right incoming audio signals. Multiple coefficients may be assigned to different frequency bands, in order to more accurately mimic specific characteristics of small and large rooms or halls.

The functionality of the ASPS 202 is described using modules. The modules described herein are defined to include software, hardware or some combination of hardware and software executable by the processor. Software portions of modules may include instructions stored in the memory, or any other memory device that are executable by the one or more processors included in the ASPS 202 or any other processor. Hardware portions of modules may include various devices, components, circuits, gates, circuit boards, and the like that are executable, directed, and/or controlled for performance by the processor.

The modules include a room model 226 that may generate artificial surround sound signals using the incoming audio signals provided on the left audio channel 210 and the right audio channel 212. Room model 226 may generate the surround sound signals using any surround sound signal generation technique that involves modeling a room. In one example, room model 226 receives the incoming audio signals and a number of user input parameters associated with spatial attributes of a room, such as "room size" and "stage distance". The input parameters may be used to define a listening room and generate coefficients, room impulse responses, and scaling factors that can be used to generate surround sound signals. Examples of generation of a synthesized ambient sound field using the spatial attributes of a room are discussed in US Patent Publication No. 2009/0147975 published Jun. 11, 2009. In FIG. 2, room model 226 uses the incoming audio signals on the left audio channel 210 and right audio channel 212 to create a synthesized ambient sound field by generating additional synthesized surround sound channels 244, such as four synthesized surround sound channels (SLS, SRS, SLB, and SRB). The synthetically generated surround sound signals 244 may include a synthetic left side signal (SLS), a synthetic right side signal (SRS), a synthetic left back signal (SLB), and a synthetic right back signal (SRB). In other examples, techniques for generating artificial surround sound signals that do not employ room modeling may be used to generate the synthesized surround sound signals on the surround sound channels 244.

In FIG. 2, the energy of the synthesized ambient sound field generated by room model 226 may be automatically controlled in real-time using estimated features of the incoming data. Estimated features of the incoming data may include determination of estimated ambient energy based on the incoming audio signals provided on the left audio channel 210 and the right audio channel 212. One or more final gain factors for application to each of the synthesized ambient surround sound signals may be obtained through a nonlinear mapping function module 228 using the ambience estimate control coefficient 242. The final gain factors may be applied to the synthetic surround sound channels (SLB, SRB, SLS, and SRS) 244, such as via summation, using an overall gain module 230. Controlling, using the gain factors, the magnitude of artificially generated ambient energy in real-time based on the estimated ambient energy in the source signal (such as the left audio channel 210 and the right audio channel 212) allows for adjustment of room impression, envelopment and stage distance. This is useful, for example, in surround sound systems that receive varying program material during a broadcast that cannot easily be continuously adjusted (e.g., automotive installations) without changes in the audio output becoming noticeable to a listener. The ambience estimate control coefficient 242 may be substantially continuously updated by the audio signal processor module 222, depending on music program statistics derived from the incoming audio signals provided on the left audio channel 210 and the right audio channel 212.

The center audio channel 240 may be derived by the audio signal processor module 222 from the stereo source signal provided on the left audio channel 210 and the right audio channel 212. The center audio signal may be extracted and provided on the center audio channel 240 to drive a dedicated center speaker. In general, the center channel component may be extracted from the left and right components using a center channel extraction technique, such as using the differences in the spatial content between the left and right components to identify common content. The frequencies not identified as common content may be attenuated resulting in extraction of audio content that forms the center channel component.

The extracted center audio channel 240 may be provided to a width matrix module 224. In addition, the incoming audio signals provided on the left audio channel 210 and the right audio channel 212 may be supplied to a delay compensation module 220 to account for the processing time of the audio signal processor module 222. The delay compensation module 220 may be an all pass filter, or any other form of signal processing technique or mechanism that time delays the incoming audio signals provided on the left audio channel 210 and the right audio channel 212, and provides the time-delayed incoming audio signals to the width matrix module 224.

In this way, the delayed incoming audio signals provided on the left audio channel 210 and the right audio channel 212 may be supplied to the width matrix module 224 substantially in phase with the extracted center audio signal provided on the center audio channel 240. The width matrix module 224 may use the delayed incoming audio signals on the left audio channel 210 and the right audio channel 212, and the extracted center audio signal generated on the center audio channel 240 to produce output channels 246 that include surround sound signals L, R, C, LS, and RS to drive one or more corresponding loudspeakers in an audio system.

The width matrix module 224 may provide the output channels 246 with adjustable width control. The adjustable width control may be used to vary the effective width, or listener perceived width of the surround sound presentation being produced on a virtual sound stage. In one example, the width of the virtual sound stage can be set to 0 to 90 degrees, where 0 degrees represents a relatively small perceived sound stage, and a 90 degree sound stage represents a very large perceived sound stage with 45 degrees appearing at substantially the middle, or center of the listener perceived sound stage. The adjustable width control may be manually entered by a user, selected by a user from a preset list of available values, automatically set by the processor, or determined by any other means.

The outputs of the width matrix module 224 may be a left channel signal, a right channel signal, and a center channel signal that are provided directly as center (C), left (L), and right (R) output channels of the respective output channels 246. The width matrix module 224 may also output a left side signal (LS) and a right side signal (RS) that are derived from the delayed left and right audio signals and the extracted center channel signal in accordance with the adjustable width control. The left side signal (LS) and a right side signal (RS) output by the width matrix module 224 may be output to respective summation modules 250 and 252. The left side signal (LS) may be combined with the synthesized left side signal (SLS) provided by the overall gain module 230 using the summation module 250 to form a left side output signal on the left side channel output (LS) of the output channels 246. In addition, the right side signal (RS) may be combined with the synthesized right side signal (SRS) provided by the overall gain module 230 using the summation module 252 to form a right side output signal on the right side channel output (RS) of the output channels 246.

The overall gain module 230 may also output the synthesized left back signal (SLB) as a left back output signal on a left back output channel (LB) included among the output channels 246. In addition, overall gain module 230 may also output the synthesized right back signal (SRB) as a right back output signal on a right back output channel (RB) included among the output channels 246. The resulting output signals (L, R, C, LS, RS, LB, RB) on the output channels 246 may be used to drive one or more corresponding loudspeakers in a listening area. In other examples, fewer or greater numbers of output channels and corresponding output signals may be generated with the ASPS 202.

Figure 3:
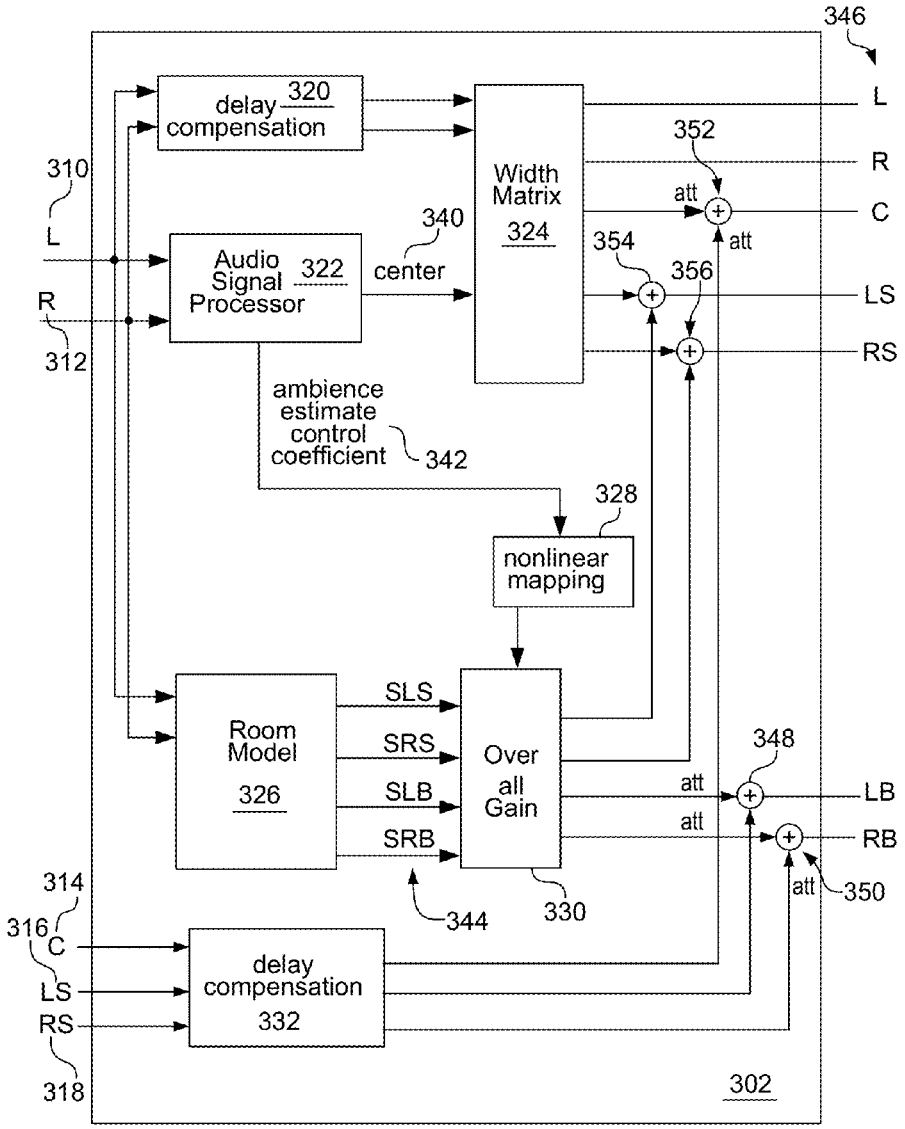
FIG. 3 illustrates a block diagram representation of an example ASPS for upmixing five to seven channels.

FIG. 3 is an example block diagram that depicts an example audio surround processing system (ASPS) 302 showing components for up-mixing from five channels to seven channels. In other examples fewer or greater numbers of input and output channels may be used in the up-mixing operation. The ASPS 302 of this example can be applied to further enhance original surround sound channels, such as recorded surround music (e.g., movie soundtracks). Similar to FIG. 2, ASP 322 of ASPS 302 generates an ambience estimate control coefficient 342 and derives a center audio channel 340 from incoming audio signals on the left audio channel 310 and right audio channel 312. Ambient sound in the form of synthetically produced surround sound signals 344 may be generated with a room model module 326. The synthetically generated surround sound signals 344 may include a synthetic left side signal (SLS), a synthetic right side signal (SRS), a synthetic left back signal (SLR), and a synthetic right rear signal (SRR). In one example, the synthetically generated surround sound signals 344 may be generated through linear filtering with a predefined optimized room model. The ambience estimate control coefficient 342 may be applied to a nonlinear mapping module 328 to determine a gain for each of the synthesized surround sound signals. The gains for each of the synthesized surround sound signals may be used to control the overall gain module 330 to selectively and independently apply gain to the ambient surround sound signals. The gains may be respectively applied to the synthetic surround sound channels (SLB, SRB, SLS, and SRS) 344 using the overall gain module 330, such as via summation of the overall gain and the surround sound channels (SLB, SRB, SLS, and SRS) 344.

The center audio signal on the center channel 340 may be derived from the stereo source signal, and may be used to drive a dedicated center speaker from a center output (C) of the output channels 346 following processing by the width matrix module 324. Derivation of the center audio signal may be based on extraction of a portion of the audio content from each of the incoming audio signals on the left audio channel 310 and right audio channel 312. The extracted center channel 340, together with the source signal after being delayed by the delay compensation module 320, may be fed into the width matrix module 324, which produces the output channels 346 (loudspeaker channels L, R, C, LS, and RS) with adjustable width control. The input surround sound channels (C 314, LS 316, RS 318) may be delayed in time with delay compensation module 332. Delay compensation module 332 may be one or more filters, such as all pass filters, or any other mechanism or technique capable of introducing time delay of the incoming surround sound channels (C 314, LS 316, RS 318). The incoming surround sound channels (C 314, LS 316, RS 318) may be time delayed to maintain phasing with the synthetic surround sound signals generated with the room model module 326 from the incoming audio signals on the left audio channel 310 and right audio channel 312.

The delayed incoming surround sound channels (C 314, LS 316, RS 318) may be processed through the delay compensation module 332 to maintain phase with the audio signals on the left and right channels 310 and 312 that are being separately processed. The delayed left side signal on the left side channel (LS) 316 may be superimposed on the synthetic left back signal (SLB) included in the upmixed sound field at a summation point 348. The delayed left side signal and the synthetic left back signal (SLB) may be attenuated with attenuation factors, such as −3 dB to −6 dB at the summation point 348 and provided as a left back output signal on a left back output channel (LB) included in the output channels 346. Similarly, the delayed right side signal on the right side channel 318 may be attenuated with attenuation factors and superimposed on the attenuated synthetic right back signal (SRB) included in the upmixed sound field at a summation point 350 and provided as a right back signal on a right back output channel (RB) included in the output channels 346. In addition, the delayed center signal on the center channel 314 may be attenuated with attenuation factors and superimposed on the center channel 340 following processing of the center channel signal by the width matrix 324 and attenuation by a summation point 352. The output of the summation point 352 may be a center output signal on the center output channel included among the output channels 346. The attenuation factors may be variable to allow balancing of the energies of the original five channel soundfield provided by the audio signals, and the up-mixed five channel soundfield, in order to provide the best listening experience. During operation, the ratio of the attenuation factors may be varied depending on the source material, for example depending on how much room information and ambience is already contained in the source material provided in the audio signals.

The synthetic left side signal (SLS) included in the upmixed sound field may be combined with the left side signal generated by the width matrix 324 at a summation point 354 to form a left side output signal on a left side output channel (LS), and the synthetic right side signal (SRS) included in the upmixed sound field may be combined with the right side signal generated by the width matrix 324 at a summation point 356 to form a right side output signal on a right side output channel (RS). The left and right side output channels (LS and RS) may be included among the output channels 346. The delayed left and right signals may be processed by the width matrix 324 and output as left and right output signals on left and right output channels (L and R) included among the output channels 346. The summation points 348, 350 and 352 may attenuate the respective signals with attenuation factors at the respective summation points (typically, attenuation=(−3 to −6) dB), whereas attenuation may be absent from the summation points 354 and 356. In other examples, other configurations of attenuation at the summation points may be used.

Figure 4:
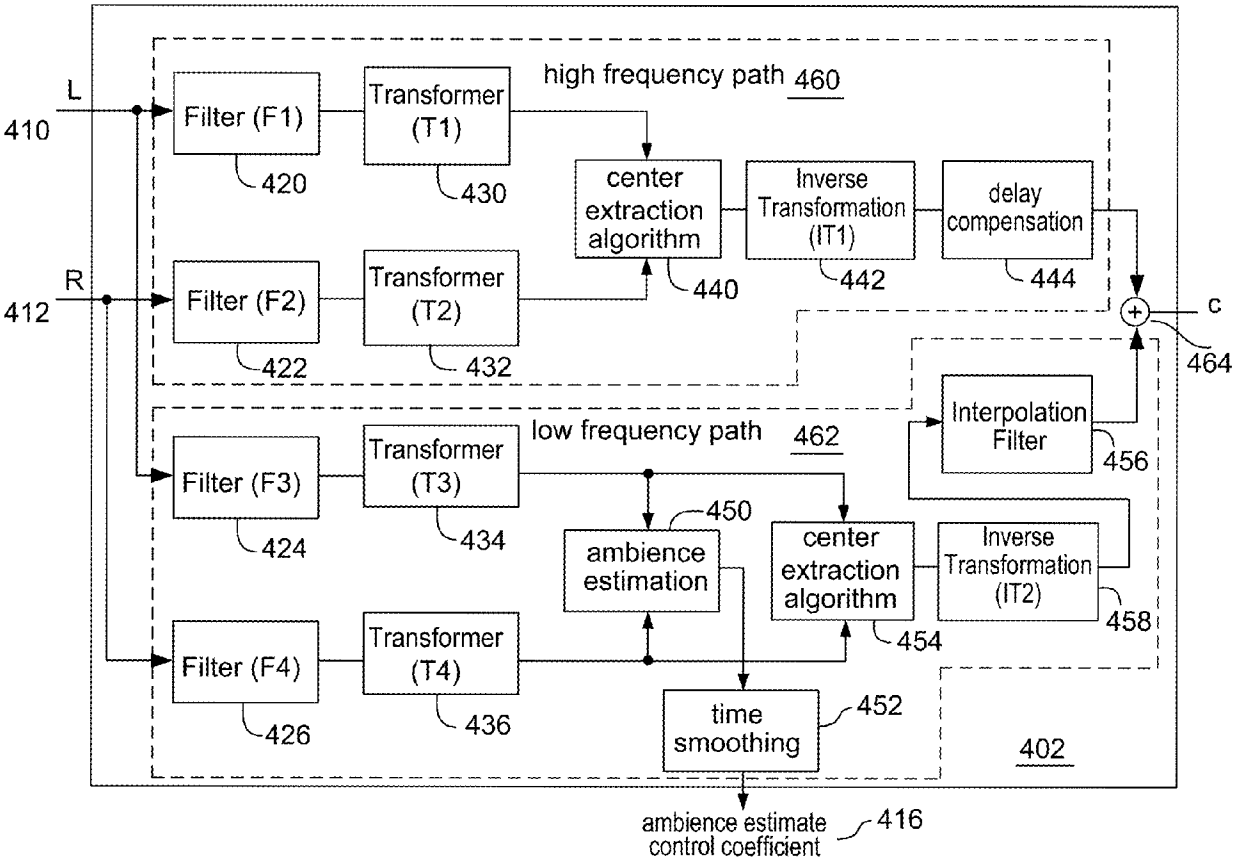
FIG. 4 illustrates a block diagram representation of an example audio signal processor (ASP).

FIG. 4 illustrates an example block diagram representation of an audio signal processor module (ASP) 402 which could be the ASP 222 of FIG. 2, or the ASP 322 of FIG. 3. In FIG. 4, the incoming audio signals on the left audio channel 410 and right audio channel 412 are split into two paths, a high-frequency path 460 and a low frequency path 462 using crossover filters and decimation. The high frequency components of left audio signal are obtained by filtering the left audio channel 410 using filter module F1 420. The high frequency components of right audio signal are obtained by filtering the right audio channel 412 using filter module F2 422. The low frequency components of left audio channel are obtained by filtering the left audio channel 410 using filter module F3 424. The low frequency components of right audio signal are obtained by filtering the right audio channel 412 using filter module F4 426.

These high and low frequency components may be first and second components of the input audio signal that are independently filtered, transformed and processed. In one example, the filters F1 and F2 420 and 422 of the high frequency path may use a low-order recursive Infinite Impulse Response (IIR) high pass filter, while the filters F3 and F4 424 and 426 of the low frequency path may use a pair of Finite Impulse Response (FIR) decimation filters.

Transformer module T1 430 receives the high frequency components of left audio channel 410. Transformer module T2 432 receives the high frequency components of right audio channel 412. Transformer module T3 434 receives the low frequency components of left audio channel 410. Transformer module T4 436 receives the low frequency components of right audio channel 412. Each transformer 430, 432, 434, 436 may transform the respective audio signal components from a time domain into a frequency domain. In one example, the transformers 430, 432, 434, 436 employ a time/frequency analysis scheme that uses short-time Fourier transform (STFT) lengths of 128 with a hop size of 48, thereby achieving much higher time resolution than with other methods. For example, application of a single fast Fourier transform (FFT) of length 1024 results in a time resolution of (10 to 20 msec.), depending on overlap length. Using individual transformers 430, 432, 434, and 436, in the example of an STFT of length 128 and hop size of 48, the resulting time resolution may be 1 to 2 msec. Thus, by using a shorter transform length, the time resolution may now be more closely related to human perception (1 to 2 msec.). As a result, the audio signals extracted from the left and right audio channels may contain less audible artifacts such as modulation noise, coloration and nonlinear distortion.

Ambience estimation module 450 and center extraction algorithm module 454 receive the transformed low frequency left and right components from transformer T3 434 and transformer T4 436 along the low frequency path 462. The ambience estimation module 450 estimates a level of ambient energy contained in the left and right audio input signals. Time smoothing 452 may be applied to the output of ambience estimation module 450 to reduce short-term variations in order to create a smoothed version of ambience estimate control coefficient 416 that is output by the time smoothing module 452. Ambience estimate control coefficient 416 may be similar to ambience estimate control coefficients 242 and 342 discussed with respect to FIGS. 2 and 3, respectively. Smoothing may be performed with filtering, modeling, or any other technique to create a slowly evolving signal. An example smoothing technique is described later. In one example, the transformers 434, 436, the center extraction algorithm 454 and the ambience estimation module 450 in the low frequency path 462 may run at a predetermined reduced sample rate that is determined based on the sample frequency (fs) and an oversampling ratio (rs). In one example, the sample rate may be derived by:

$$fs/rs = \text{sample rate} \qquad \text{Equation 1}$$

Figure 5:
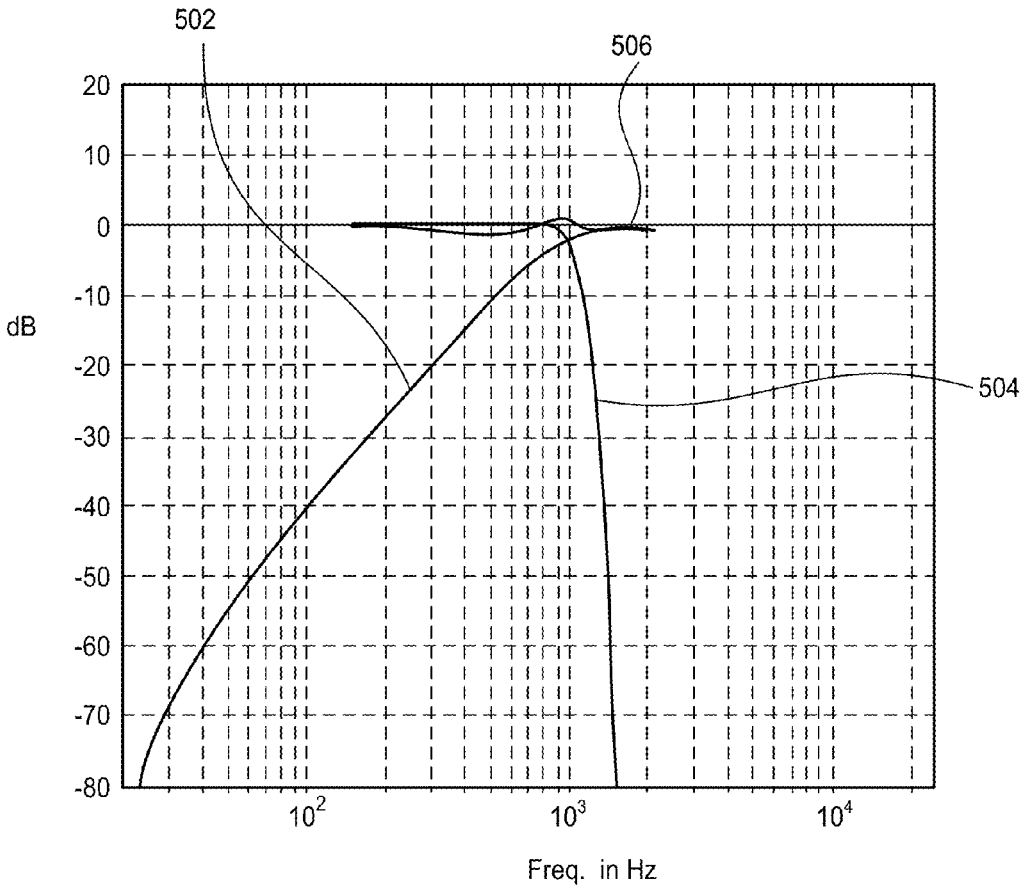
FIG. 5 illustrates an example summed response of a decimation filter and an interpolation filter.

Thus, where fs=48 kHz, rs=16, the sample rate may be 3 kHz, in accordance with a chosen crossover frequency of 1-1.5 kHz (FIG. 5). Using the predetermined reduced sample rate, frequency resolution may be improved due to sub-sampling of the lower frequency band in the low frequency path 462. Also, aliasing distortion, which can be a problem in poly-phase filter banks with nonlinear processing, may be minimized or avoided completely. Use of the predetermined reduced sample rate may also lead to exceptional fidelity and sound quality with artifacts suppressed to below the audibility of a human listener, because of the resulting high frequency resolution, while not compromising high time resolution.

Using a reduced sample rate may also result in an increase, such as an rs-fold increase, in the low frequency resolution of the audio signal, thus the same downsampling ratio can be used for the filters F3 and F4 424 and 426, and also for the interpolation filter 456. In one example, the filters F3 and F4 424 and 426 may be decimation filters. An example of the filters F3 and F4 424 and 426 and interpolation filter 456 may be linear-phase FIR filter designs using least-squared error minimization with a passband specified at 0.5/rs, a stopband at 1/rs, and a filter degree of 256, which may provide suppression of aliasing components above a sampling frequency, such as fs/16=1.5 kHz in the low frequency path 462.

The center extraction algorithm module 440 in the high frequency path 460 extracts a high frequency center channel component based on the transformed high frequency left and right components from transformer T1 430 and transformer T2 432. Similarly, the center extraction algorithm module 454 of the low frequency path 462 may extract a low frequency center channel component based on the transformed low frequency left and right components from transformer T3 434 and transformer T4 436. The high and low frequency center channel components may be extracted from the left and right components using a center channel extraction technique, such as using the differences in the spatial content between the left and right components to identify common content. The frequencies not identified as common content may be attenuated resulting in extraction of audio content that forms the high and low frequency center channel components.

In FIG. 4, inverse transformer IT1 442 of the high frequency path 460 receives the extracted high frequency center component from center extraction algorithm module 440 and transforms the center component from the frequency domain to the time domain. Inverse transformer IT2 458 of the low frequency path 462 receives the center components from center extraction algorithm 454 along the low frequency path 462 and transforms the center components from the frequency domain to the time domain.

Inverse transformation by the inverse transformers IT1 and IT2 442 and 454 may be performed with a Short-Term Fourier Transform (STFT) block similar to the transformation by the transformers T1, T2, T3, T4, 430, 432, 434, 436. In one example, recombination of the center channel components after respective center audio channel extraction processing in the high and low frequency paths 460 and 462 is accomplished using inverse STFTs and interpolation from the reduced sample rate fs/16 to the original sample rate fs.

The delay compensation 444 in the high frequency path 460 may be used to match the higher latency due to FIR filtering of the low frequency path 462. Delay compensation may be performed with one or more all pass filters, or any other form of signal processing technique or mechanism that time delays the output of the time domain based signal from the inverse transformer IT1 442, and provides the time-delayed signal to a combiner 464. The Interpolation filter 456 restores the reduced sample rate to the original sample rate. In one example, the reduced sample rate fs/16 may be interpolated to obtain the original sample rate fs. The center audio components extracted from the high frequency path 460 and low frequency path 462 are combined by the combiner 464 to form the center channel signal on the center audio channel, such as the center audio channel 240 or 340.

FIG. 5 illustrates an example combined response based on the filtering in the high frequency path 460 and the low frequency path 462 of FIG. 4. In FIG. 5, an example high pass filter response 502 is combined with an example low pass filter response 504 resulting in a combined response 506. The high pass filter response 502 may be based on the high pass filters F1 and F2 420 and 422 included in the high frequency path 460. In one example, the high pass filters F1 and F2 420 and 422 are configured as second order Butterworth filters with a (−3 dB) rolloff frequency of about 700 Hz to about 1000 Hz. The low pass filter response 504 may be a summed response based on the low pass filters F3 and F4 424 and 426 being finite impulse response (FIR) decimation filters summed with the interpolation filter module 456 in the form of an FIR interpolation filter. The combined response 506 is substantially linear and flat for the previously discussed example filter parameters.

Figure 6:
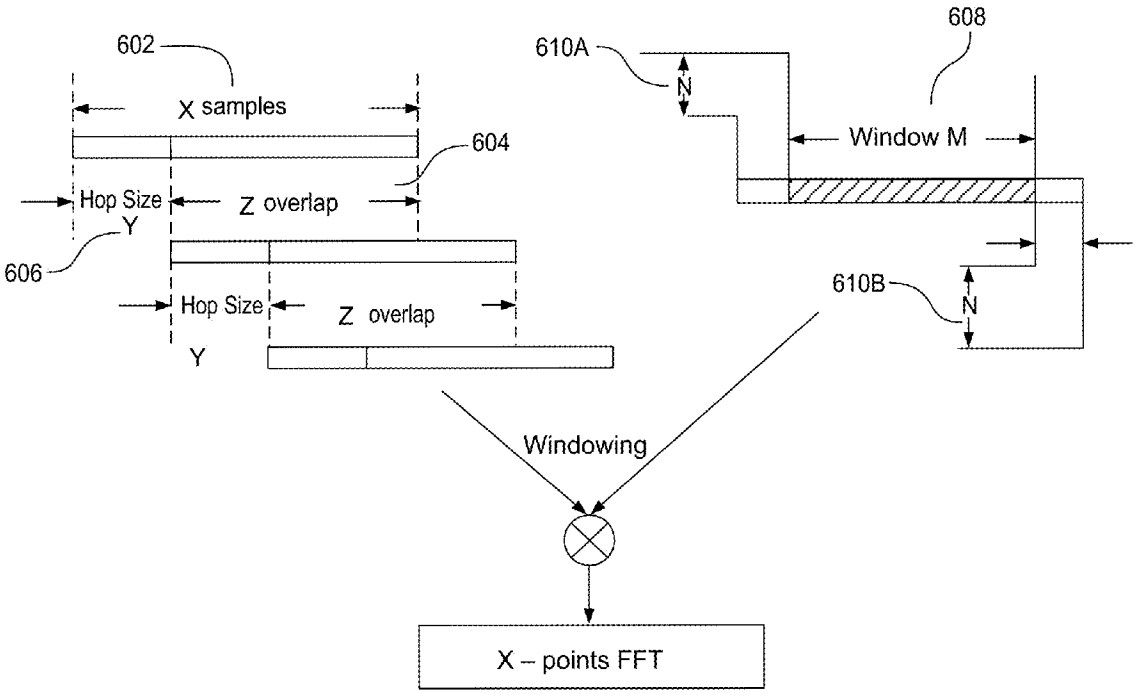
FIG. 6 illustrates a block diagram representation of an example short-time Fourier transform (STFT) implementation using an overlap-add method.

FIG. 6 illustrates a block diagram representation of an example STFT implementation for the filters F1, F2, F3, F4 420, 422, 424, 426, and the interpolation filter 456. In this example, the STFT implement uses an overlap-add method. The overlap-add method of digital filtering may involve using a series of overlapping Hanning windowed segments of the input waveform and filtering each segment separately in the frequency domain. After filtering, the segments may be recombined by adding the overlapped sections together. The overlap-add method may permit frequency domain filtering to be performed on continuous signals in real time, without excessive memory requirements. The STFT may have a predetermined FFT length 602 of X samples, a predetermined overlap length 604 of Z samples, and a hop size 606 equal to the difference between the FFT length 602 and the overlap length 604. In this example, the FFT length 602 is 128 samples, and the overlap length 604 is 80 samples, thus creating a hop size 606 of 48 (128−80) samples. In other examples, the FFT length 602 and overlap length 604 may be different. The use of a relatively short FFT length allows for time resolution of 1 msec at fs=48 kHz. Sampling may be performed with a windowing function 608 of a predetermined window size (M) that includes a predetermined number of zero samples (N) 610. In this example, a 96-tap Hanning window 608 is applied. In other examples, a 48-tap Hanning window, a 192-tap Hanning window, or any other size Hanning window may be used. In FIG. 6, the Hanning window 608 includes a predetermined number, such as sixteen, of zero samples (610A and 610B) on each side of the Hanning window 608. The sets of zero samples may be positioned on either side of the Hanning window 608 in order to minimize transient distortion due to pre- and post-ringing of applied signal processes in the spectral domain.

Figure 7:
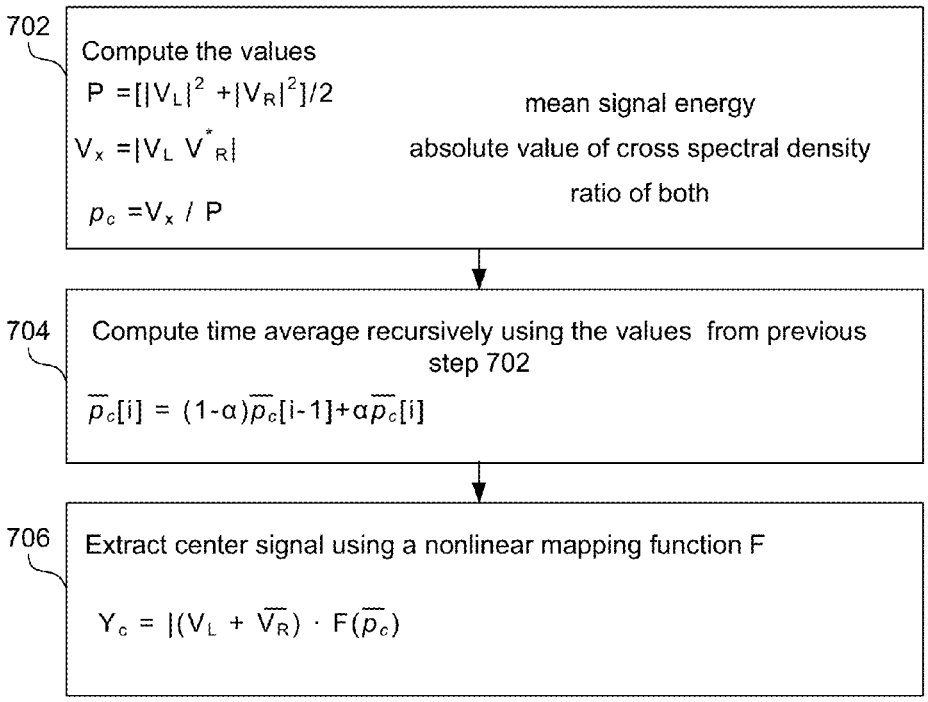
FIG. 7 illustrates a flowchart of an example process for extracting a center channel from a two-channel audio signal.

FIG. 7 illustrates a flowchart of an example process for extracting a center channel from a two-channel audio signal that may be used with center extraction algorithm module 440 in the high frequency path 460, or the center extraction algorithm 454 in the low frequency path 462. Input signals in FIG. 7 are complex vectors of the short-term signal spectra of the left input signal, $V_L$, and the right input signal, $V_R$, respectively. A time index i is also depicted, which denotes the actual block number (i=i+1 every hop size=48 samples). A mean signal energy P, an absolute value V, of the cross spectral density between both input signals ($V_L$ and $V_R$), and their quotient $p_c$ in the form of a ratio, are computed at block 702. A time average vector of $p_c$, $\overline{p}_c$, by means of a recursive estimate with an update coefficient $\alpha$ (typically $\alpha$=0.2/rs, rs=16 oversampling ratio) is computed at block 704. The coefficient $p_c$ is bound between zero when there is no cross correlation between the left and right channels, and therefore the left and right audio signals are not contributing to the desired center channel, and one when the left and right signal components are highly correlated or identical, i.e., fully contributing to the center channel. The desired center channel output signal may be obtained (extracted) by multiplying the sum of the inputs (mono signal) with a non-linear mapping function F of time average vector $\overline{p}_c$ at block 706. The function F can be optimized for the best compromise between channel separation and low distortion.

Figure 8:
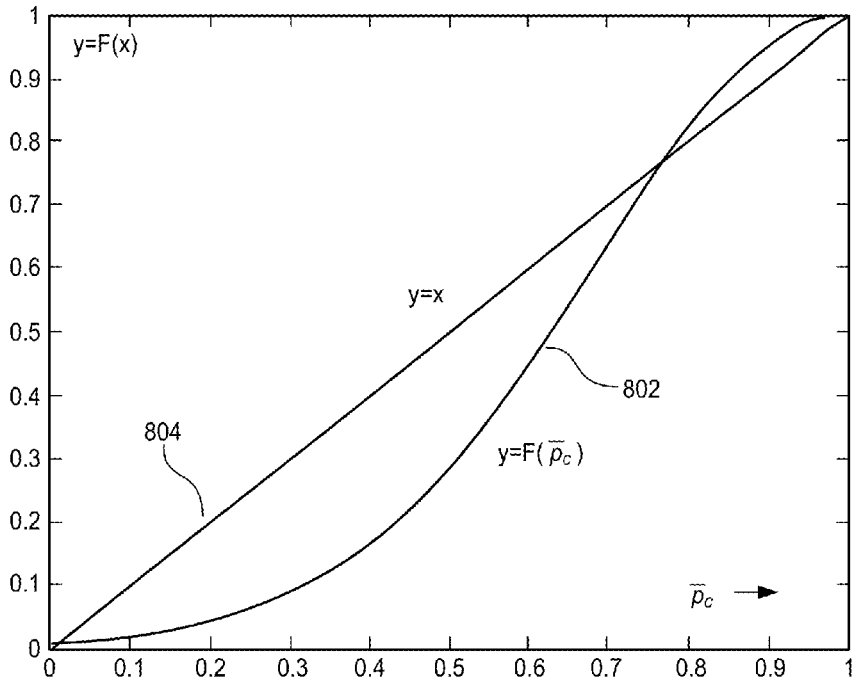
FIG. 8 illustrates a an example nonlinear mapping function.

FIG. 8 illustrates mapping of an example representation of the non-linear function F 802 as a function of the time average vector of $p_c$ versus a linear function 804. At $x=p_c$ smaller than, for example, values of 0.8, the curve is bent below y=F(x), yielding an emphasized suppression of uncorrelated components, thereby narrowing the window of components that are assigned to the extracted center signal.

Figure 9:
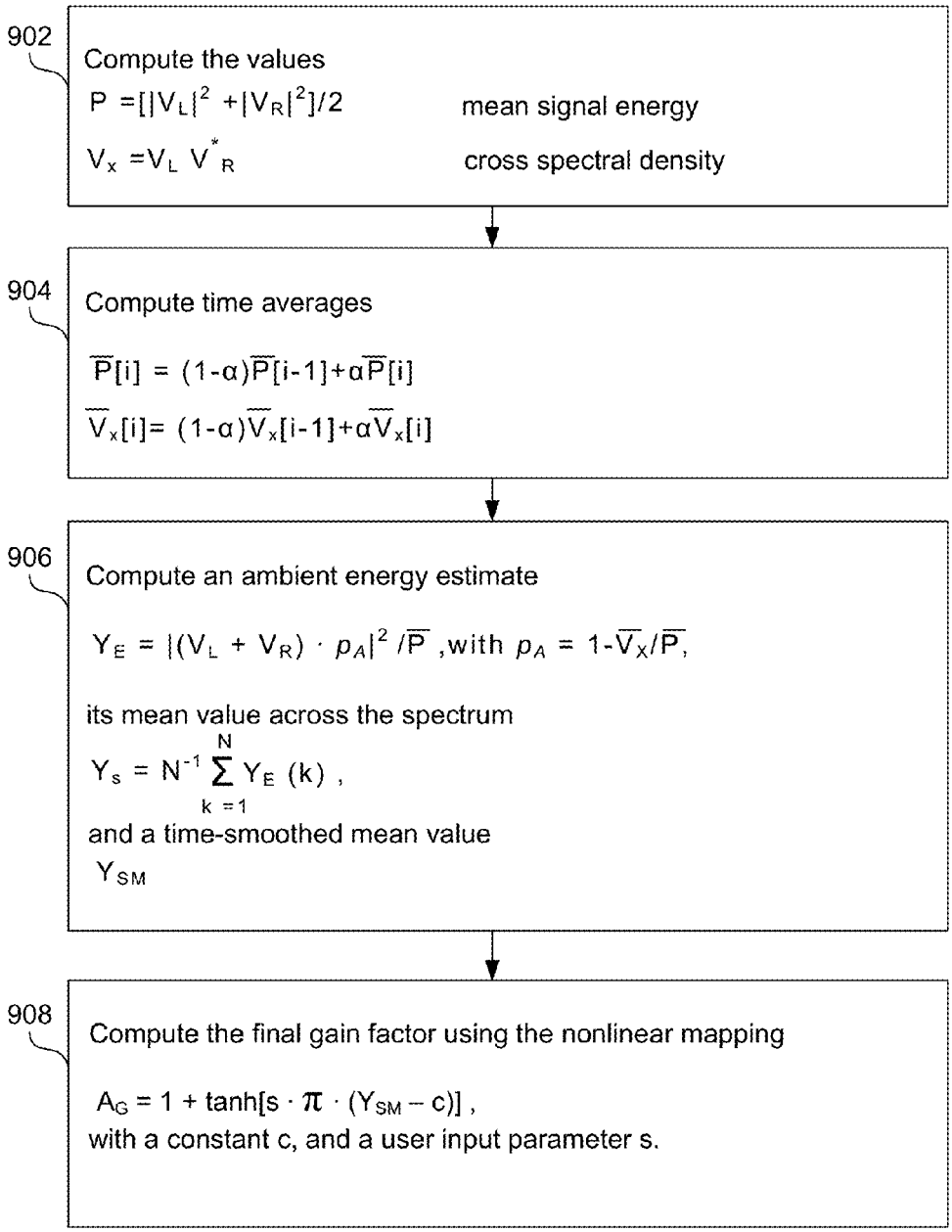
FIG. 9 illustrates a flowchart representation of an example process for generating an ambience estimate control coefficient from a two-channel audio signal.

FIG. 9 illustrates a flowchart of an example process for generating an ambience estimate control coefficient from a two-channel audio signal using the ASP module 222 or 322 of FIGS. 2 and 3. Similar to the process described for center extraction, mean signal energy (P) and the cross spectral density ($V_x$) of the input signal are computed at block 902 using the left and right audio low frequency signal components ($V_L$ and $V_R$) from the low frequency path 462. The time averages of P and 14, which is a complex vector in the case of $V_x$ with a coefficient $\alpha$ chosen as a predetermined value, such as between 0.1 and 0.3, are computed at block 904. An ambient energy estimate $Y_E$ of the level of ambient energy contained in the low frequency component of the left and right audio signal is computed using the formula depicted in block 906. The mean value of the ambient energy estimate $Y_E$ across the spectrum, $Y_S$, which is a real-valued, time-dependent function, is computed. N is the FFT length (N=128), and k the frequency index. Time smoothing is applied by the time smoothing module 452 to reduce short-term variations in order to get a smoothed version $Y_{SM}$ of the ambience estimate control coefficient 416. The final gain factor $A_G$ is obtained using the nonlinear mapping module 228 or 328 through a nonlinear mapping using the tan h function at block 908. In one example, the user may control the level of automation of calculation of the final gain factor $A_G$ by setting a parameter s having a value from 0 to 100% (for example, s=0 means no automation, s=1 means fully automatic mode). In the case of s=0, the amount of artificially generated ambience is controlled by the user only, not by the estimated ambience. Full automation without user control is achieved with s=1. In between s=0 and s=1, the user can choose a preferred ambient sound field energy setting, which is however still controlled in an automated way around the user's chosen setting. Constant c may be set to a predetermined value. In one example, the constant c may be set to a value of 0.35. The gain factor $A_G$ may be applied to one or more of the synthesized surround audio signals (SLS, SRS, SLR, SRB). Where the gain factor $A_G$ is selectively applied to the synthesized surround sound signals such that the gain factor $A_G$ is not uniformly applied to all the synthesized surround audio signals, the gain module 230 or 330 may include filter pairs to split the audio signal into low and high frequency components that are separately controlled.

Figure 10:
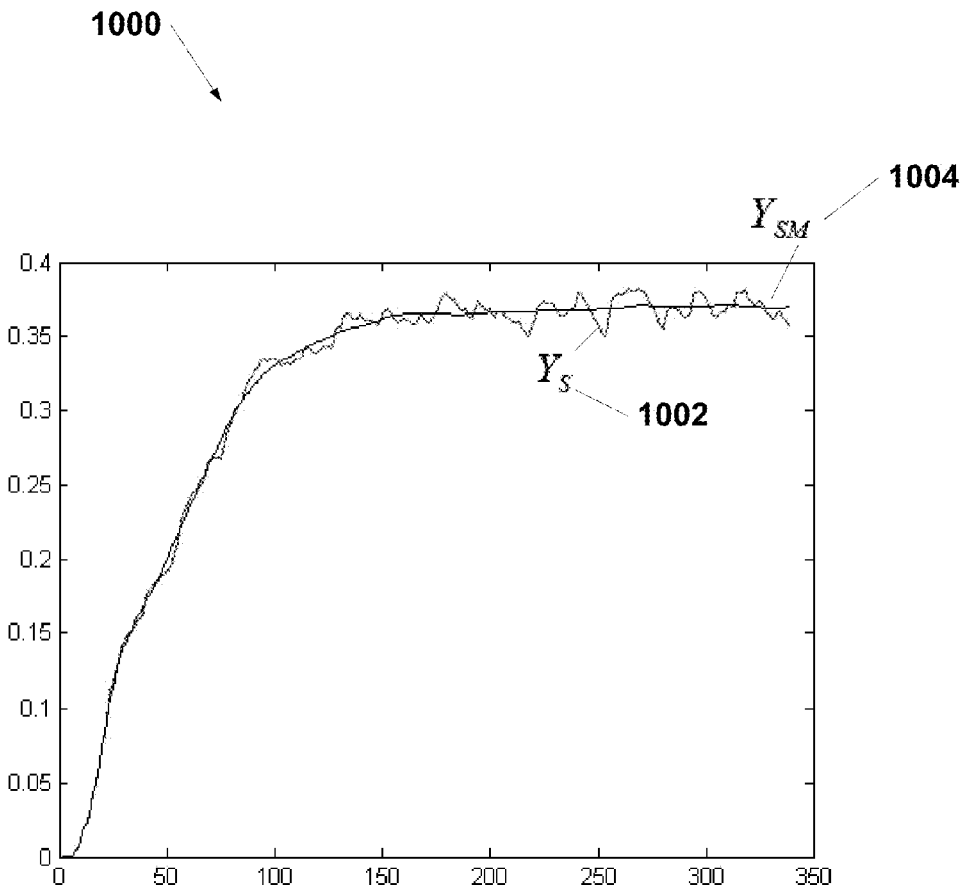
FIG. 10 illustrates an example of an estimated ambience control coefficient and a smoothed version of the estimated ambience control coefficient 1004.

FIG. 10 illustrates a graph depicting an example of an estimated ambience control coefficient and a smoothed version of the estimated ambience control coefficient. Estimated ambience control coefficient $Y_S$ 1002 and smoothed version of the estimated ambience control coefficient $Y_{SM}$ 1004 are shown. In the example of FIG. 10, after a time index of approximately 150 (150×hop size 48×oversampling ratio (rs) 16=115200 samples, which corresponds to 115200/48000 sec=2.4 sec) the ambience estimation process performed by the ambience estimation module 450 has analyzed an audio signal, such as a music signal and the estimated ambience control coefficient has settled to a nearly constant value of 0.37. The smoothed version of the estimated ambience control coefficient may be used by the overall gain module 230 or 330 to determine the overall gain factor(s) of the pre-generated synthetic surround sound channels.

Figure 11:
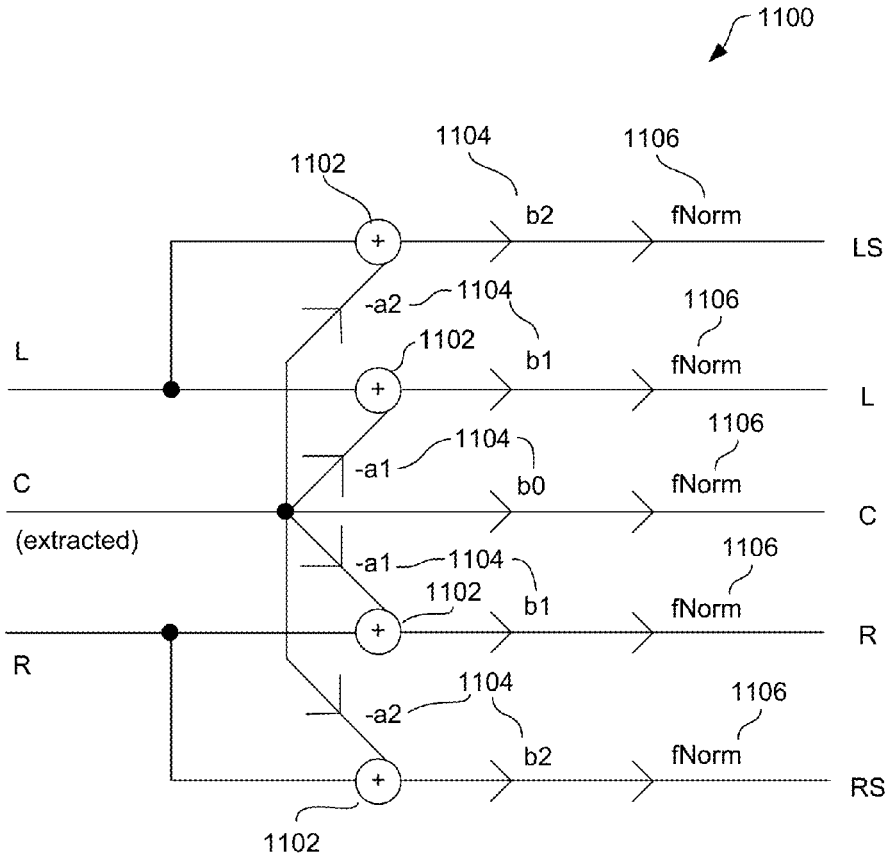
FIG. 11 illustrates an example width control matrix used to produce a frontal stage sound.

FIG. 11 is an example width control matrix used by the width matrix module 224 or 324 to produce the frontal stage sound represented by the left (L) and right (R) audio signals, and the extracted center channel signal (C). In FIG. 11, the width control matrix is used to map the audio signals from the audio channels (L, C, and R) to the loudspeaker output channels (L, C, R, LS, and RS) 246 or 346 using four summation points 1102, and five control parameters (a1, a2, b0, b1, b2) 1104. In other examples, additional or fewer summation points and control parameters may be used depending on the upmixing desired. Parameters a1 and a2 may be predetermined fixed, empirically defined values. In the following example chart (Chart 1), parameters a1 and a2 are set to 0.53 and 0.75 respectively. Parameters b0, b1, b2 may be variable values that are dependent on a predefined "StageWidth" value, as depicted in Chart 1. The "StageWidth" value may be provided by the user, either by manual input of a value or user selection from a preset listing of values. A scale factor "fNorm" 1106, calculated in accordance with below equation, may be applied to ensure substantially equal loudness for each setting of "StageWidth".

CHART 1 a1=0.53, a2=0.75;

b0=(1−StageWidth)/100, StageWidth from 0 to 60.

b1=1−(45−StageWidth)/100, if StageWidth<=45, b1=1.0, if StageWidth>45 b2=0, if StageWidth<30 b2=(StageWidth−30)/50, if StageWidth<80, b2=1.0; if StageWidth>=80.

$$fNorm=1.0/\sqrt{(2b_2^2(1-a_2)^2+2b_1^2(1-a_1)^2+b_0^2)}$$

Figure 12:
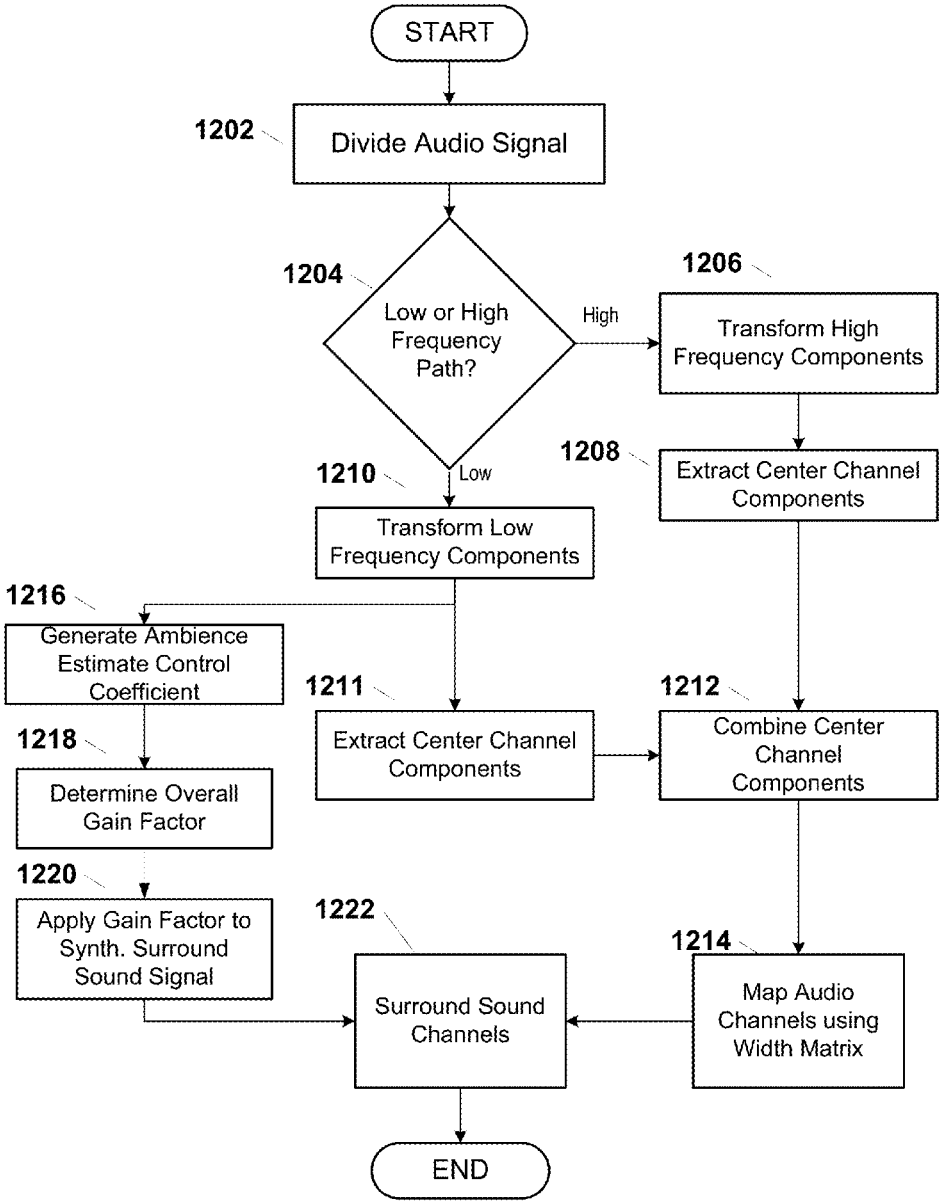
FIG. 12 illustrates an example flow diagram for generating surround sound from an audio signal having at least two channels.

FIG. 12 illustrates an example operational flow diagram of the audio sound processing system (ASPS) 104 generating surround sound from an audio signal having at least two channels. The at least two channels include a left audio channel and a right audio channel.

At block 1202, the source audio signal having at least two channels is divided into a high frequency component and a low frequency component based on a predetermined high frequency range and a predetermined low frequency range. The divided components follow two separate processing paths at block 1204. Along the high frequency path, the high frequency components are transformed from a time domain to a frequency domain at block 1206. At block 1208 a high frequency center channel component is extracted by a center channel extraction algorithm module using the high frequency components derived from the left and right audio channels. Along the low frequency path, the low frequency components are transformed from a time domain to a frequency domain at block 1210. At block 1211, a low frequency center channel component is extracted by a center channel extraction algorithm module using the low frequency components derived from the left and right audio channels.

At block 1212, the output center channel components from the high frequency path and low frequency path center channel extraction algorithm modules are recombined to create a center channel signal (C). A width control matrix is used to map the audio channels (L, C, and R) to the frontal sound stage channels (L, C, R, LS, and RS) at block 1214. Also, at block 1216 an ambience estimate control coefficient is generated along the low frequency path after transformation at block 1210. The overall gain factor for synthetic surround sound signals generated from the left and right audio channel signals is obtained using the ambience estimate control coefficient and non-linear mapping at block 1218. At block 1220, the overall gain factor is applied to the synthetic surround sound signals. Surround sound output audio signals are generated on the surround sound output channels (L, R, C, LS, RS, LB, RB) by selective summation of the synthetic surround sound signals, the center channel signal (C) and the audio signal having at least two channels at block 1222.

The example operational flow diagram of FIG. 12 describes generation of a number of additional surround sound audio channels from a fewer number of source input audio channels in which the amount of artificially generated ambient energy is controlled in real-time by the estimated ambient energy that is contained in the source input audio signal. In other examples, the logic may include additional, different, or fewer operations. In addition, in other examples, the operations may be executed in a different order than is illustrated in FIG. 12.

The audio surround processing system 104 may be implemented in many different ways. For example, although some features are described as stored in computer-readable memories (e.g., as logic implemented as computer-executable instructions or as data structures in memory), all or part of the system and its logic and data structures may be stored on, distributed across, or read from other machine-readable media. The media may include hard disks, floppy disks, CD-ROMs, a signal, such as a signal received from a network or received over multiple packets communicated across the network. Alternatively, or in addition, the features may be implemented in hardware based circuitry and logic or some combination of hardware and software to implement the described functionality.

The processing capability of the audio surround processing system 104 may be distributed among multiple entities, such as among multiple processors and memories, optionally including multiple distributed processing systems. Parameters, databases, and other data structures may be separately stored and managed, may be incorporated into a single memory or database, may be logically and physically organized in many different ways, and may implemented with different types of data structures such as linked lists, hash tables, or implicit storage mechanisms. Logic, such as programs or circuitry, may be combined or split among multiple programs, distributed across several memories and processors, and may be implemented in a library, such as a shared library (e.g., a dynamic link library (DLL)). The DLL, for example, may store code that prepares intermediate mappings or implements a search of the mappings. As another example, the DLL may itself provide all or some of the functionality of the system.

The audio surround processing system 104 may be implemented with additional, different, or fewer modules with similar functionality. In addition, the audio surround processing system 104 may include one or more processors that selectively execute the modules. The one or more processors may be implemented as a microprocessor, a microcontroller, a digital signal processor (DSP), an application specific integrated circuit (ASIC), discrete logic, or a combination of other types of circuits or logic. In addition, any memory used by the one or more processors may be a non-volatile and/or volatile memory, such as a random access memory (RAM), a read-only memory (ROM), an erasable programmable read-only memory (EPROM), flash memory, any other type of memory, such as a non-transient memory, now known or later discovered, or any combination thereof. The memory used by the one or more processors may include an optical, magnetic (hard-drive) or any other form of data storage device.

The one or more processors may include one or more devices operable to execute computer executable instructions or computer code embodied in memory to extract a center channel and generate an ambience estimate control parameter. The computer code may include instructions executable with the one or more processors. The computer code may include embedded logic. The computer code may be written in any computer language now known or later discovered, such as C++, C#, Java, Pascal, Visual Basic, Perl, HyperText Markup Language (HTML), JavaScript, assembly language, shell script, or any combination thereof. The computer code may include source code and/or compiled code.

While the foregoing descriptions refer to the use of a surround sound system in enclosed spaces, such as a home theater or automobile, the subject matter is not limited to such use. Any electronic system or component that measures and processes signals produced in an audio or sound system that could benefit from the functionality provided by the components described may be implemented.

Moreover, it will be understood that the foregoing description of numerous implementations has been presented for purposes of illustration and description. It is not exhaustive and does not limit the claimed inventions to the precise forms disclosed. Modifications and variations are possible in light of the above description or may be acquired from practicing the invention. The claims and their equivalents define the scope of the invention. While various embodiments of the innovation have been described, it will be apparent to those of ordinary skill in the art that many more embodiments and implementations are possible within the scope of the innovation. Accordingly, the innovation is not to be restricted except in light of the attached claims and their equivalents.

We claim:

1. An audio surround processing system comprising:

a processor;

a memory in communication with the processor;

an audio signal processor module executable by the processor to divide a source audio signal having at least two audio channels into a first set of components in a first frequency range and a second set of components in a second frequency range, where the first frequency range of the first set of components is lower than the second frequency range of the second set of components;

the audio signal processor module executable by the processor to transform the first set of components from a time domain to a frequency domain;

the audio signal processor module further executable by the processor to estimate an ambient energy level using only the first set of components with the first set of components being in the frequency domain;

the audio signal processor module further executable by the processor to generate an ambience estimate control coefficient using the estimated ambient energy level; and the audio signal processor module further executable by the processor to determine a gain factor of a plurality of synthesized surround sound signals using the ambience estimate control coefficient.

2. The audio surround processing system of claim 1, where the source audio signal has a predetermined source sample rate, and the first set of components is sampled at predetermined sample rate that is less than the source sample rate to estimate the ambient energy level and to generate the ambience estimate control coefficient.

3. The audio surround processing system of claim 2, where the audio signal processor module is further executable by the processor to transform the second set of components from a time domain to a frequency domain using the predetermined sample rate.

4. The audio surround processing system of claim 2, where the audio signal processor module is further executable to transform the first set of components and second set of components from a time domain to a frequency domain by computation of a Short Time Fourier Transform (STFT) of the first set of components and the second set of components using the predetermined sample rate.

5. The audio surround processing system of claim 1, where the audio signal processor module is further executable by the processor to extract a first center audio signal from the first set of components, extract a second center audio signal from the second set of components, and combine the first center audio signal and the second center audio signal to generate a center channel output signal.

6. The audio surround processing system of claim 1, where the audio signal processor module is further executable by the processor to extract a center channel signal from the source audio signal, and the system further comprises a width matrix executable with the processor to receive the source audio signal and the center channel signal as inputs, generate at least two surround sound signals, and adjust a width of a listener perceived sound stage by adjustment and output of an adjusted source audio signal, the center channel signal and the at least two surround sound signals.

7. The audio surround processing system of claim 1, further comprising an overall gain module executable by the processor to apply the gain factor to at least one synthesized surround sound signal, a magnitude of gain being controlled in accordance with the ambience estimate control coefficient.

8. The audio surround processing system of claim 1, further comprising a non-linear mapping module configured to determine the overall gain using a nonlinear mapping function and the ambience estimate control coefficient.

9. The audio surround processing system of claim 1, where the audio signal processor module is further executable by the processor to determine the ambience estimate control coefficient by time smoothing an output from an estimate of the ambient energy level in the first frequency range of the first set of components, which is lower than the second frequency range.

10. A non-transitory computer-readable medium comprising a plurality of instructions executable by a processor, the computer-readable medium comprising:

instructions to divide a source audio signal having at least two channels into a first set of components in a first frequency range and a second set of components in a second frequency range, where the first frequency range of the first set of components is lower than the second frequency range of the second set of components;

instructions to transform the first set of components from a time domain to a frequency domain;

instructions to generate an ambience estimate control coefficient using an estimated ambient energy contained in only the first set of components, the first set of components being in the frequency domain; and instructions to determine a gain factor of a plurality of synthesized surround sound signals using the ambience estimate control coefficient.

11. The computer readable medium of claim 10, further comprising instructions to transform the second set of components from a time domain to a frequency domain.

12. The computer readable medium of claim 11, where the instructions to transform the first set of components and the second set of components comprises instructions to compute a Short Time Fourier Transform (STFT) of the first set of components and the second set of components.

13. The computer readable medium of claim 11, further comprising instructions to generate a first set of center audio data from the first set of transformed components, generate a second set of center audio data from the second set of transformed components, combine the first set of center audio data and the second set of center audio data, and transform the combined first and second sets of center audio data from a frequency domain to a time domain to generate a center output channel.

14. The computer readable medium of claim 13, further comprising instructions to generate at least two additional surround channels using a matrix having the source audio signal and the generated center channel as inputs.

15. The computer readable medium of claim 10, further comprising instructions to generate the ambience estimate control coefficient using a predefined parameter representing an automation level.

16. The computer readable medium of claim 10, further comprising instructions to determine the overall gain using a nonlinear mapping function.

17. The computer readable medium of claim 10, further comprising:

instructions to extract a center channel signal from the first set of components and the second set of components;

instructions to generate a surround sound signal from the source audio signal and the extracted center channel signal; and instructions to combine the surround sound signal with at least one of the synthesized surround sound signals to generate a surround sound output signal.

18. A method for audio signal processing in an audio surround processing system, the method comprising:

dividing a source audio signal having at least two channels into a first set of components in a first frequency range and a second set of components in a second frequency range, where the first frequency range of the first set of components is lower than the second frequency range of the second set of components;

transforming the first set of components from a time domain to a frequency domain;

generating an ambience estimate control coefficient using an estimated ambient energy contained in only the first set of components, the first set of components being in the frequency domain; and determining an overall gain of a plurality of pre-generated surround sound signals using the ambience estimate control coefficient.

19. The method of claim 18, further comprising transforming the second set of components from the time domain to the frequency domain.

20. The method of claim 19, where the first set of components and second set of components are transformed by computing a Short Time Fourier Transform (STFT) of the first and second sets of components.

21. The method of claim 19, further comprising generating a first set of center audio data from the first set of transformed components, generating a second set of center audio data from the second set of transformed components, combining the first set of center audio data and second set of center audio data to generate combined center audio data, and transforming the combined center audio data from a frequency domain to a time domain to generate a center output signal on a center output channel to drive a center loudspeaker.

22. The method of claim 21, further comprising generating at least two additional surround sound channels using a matrix having the source audio signal and the generated center output signal as inputs.

23. The method of claim 18, further comprising using a predefined parameter representing an automation level to generate the ambience estimate control coefficient.

24. The method of claim 18, further comprising determining the overall gain using a nonlinear mapping function.

* * * * *